US006685057B1

(12) United States Patent
Sullivan

(10) Patent No.: US 6,685,057 B1
(45) Date of Patent: Feb. 3, 2004

(54) CLIP FOR COLLAPSIBLE TUBE

(76) Inventor: Earl B. Sullivan, 2249 Copley Rd., Akron, OH (US) 44320

( * ) Notice: Subject to any disclaimer, the term of this patent is extended or adjusted under 35 U.S.C. 154(b) by 49 days.

(21) Appl. No.: 10/093,705

(22) Filed: Mar. 8, 2002

(51) Int. Cl.[7] ..... B65D 35/28; B65D 35/32
(52) U.S. Cl. ..... 222/99; 222/95
(58) Field of Search ..... 222/92, 95, 99, 222/107

(56) References Cited

U.S. PATENT DOCUMENTS

| | | | | |
|---|---|---|---|---|
| 607,530 | A | 7/1898 | Taylor | |
| 1,032,664 | A | 7/1912 | France | |
| 1,603,423 | A | * 10/1926 | Spitler | 222/99 |
| 1,987,428 | A | * 1/1935 | Whiteman | 222/99 |
| 2,083,603 | A | 6/1937 | Harwich | 221/60 |
| 2,358,989 | A | 9/1944 | March | 222/102 |
| 2,390,314 | A | 12/1945 | Massey | 222/103 |
| 2,413,323 | A | * 12/1946 | Hills | 222/107 |
| 2,678,755 | A | 5/1954 | Buras, Jr. | 222/103 |
| 2,790,579 | A | 4/1957 | Woldorf | 222/103 |
| 3,248,012 | A | 4/1966 | Adams | 222/95 |
| 3,463,359 | A | 8/1969 | Piggush | 222/103 |
| 3,675,822 | A | 7/1972 | Casali et al. | 222/103 |
| 3,854,628 | A | 12/1974 | Goings | 222/103 |
| 4,159,787 | A | 7/1979 | Wright | 222/103 |
| 4,365,727 | A | 12/1982 | Shmelkin | 222/97 |
| 4,576,314 | A | 3/1986 | Elias et al. | 222/97 |
| 4,817,823 | A | 4/1989 | Sparr, Sr. | 222/103 |
| 4,976,380 | A | 12/1990 | von Schuckmann | 222/103 |
| 5,248,065 | A | 9/1993 | Zima | 222/103 |
| 5,373,968 | A | * 12/1994 | Nelson | 222/99 |
| 5,447,255 | A | 9/1995 | Smedley | 222/102 |
| 5,549,221 | A | 8/1996 | Conlee | 222/103 |
| 5,579,956 | A | * 12/1996 | Seale | 222/107 |
| 5,743,434 | A | 4/1998 | Light | 222/103 |
| 5,782,385 | A | 7/1998 | Soon | 222/103 |
| 5,975,363 | A | 11/1999 | Haycock | 222/103 |

* cited by examiner

*Primary Examiner*—Gene Mancene
*Assistant Examiner*—Patrick Buechner
(74) *Attorney, Agent, or Firm*—Renner, Kenner, Greive, Bobak, Taylor & Weber

(57) ABSTRACT

A retainer used in conjunction with a collapsible tube, the retainer including a body adapted to contact the end of the tube; and at least one tab extending from the body laterally of the tube and adapted to selectively laterally wrap around the tube to hold a portion of the tube in a selected position.

8 Claims, 2 Drawing Sheets

CLIP FOR COLLAPSIBLE TUBE

TECHNICAL FIELD

In general, the present invention relates to dispensers, in particular, collapsible tubes used to dispense viscous fluid. More particularly, the present invention relates to a retainer that maintains the end of such a tube in a selected folded or rolled configuration. Most particularly, the present invention relates to a retainer having at least one tab that wraps around the lateral edges of the tube to hold the end in the folded condition.

BACKGROUND OF THE INVENTION

Collapsible tubes are commonly used as dispensers of various fluids including viscous materials that, due to their viscous nature, are often difficult to expel completely from the lower reaches of the tube. Localized squeezing of the tube, as with one's fingers, often results in some fluid remaining in the tube. Since collapsible tubes are universally used to store viscous fluids including, for example, toothpaste, glue, medicines, ointments, creams, and paint pigments, the subject of expelling every last drop of fluid from the tube has been the source of widespread frustration. As a result, a great deal of inventive effort, evidenced by a large number of designs dealing with the subject, has been expanded toward solving this issue.

In most designs, an implement is used to force all of the tube contents toward the open end of the tube. In several designs, a clamp or adaptor that encircles the tube and has a closely fitting slot designed to flatten the tube, while expelling the contents therefrom as the device is drawn toward the open end. The slot in these devices is made extremely narrow such that all of the contents are forced from the tube as the device is advanced and the device relies on the interference fit created by the close fitting slot to prevent the material from regressing through the slot into the collapsed portion of the tube.

In other designs, mechanical assemblies are used to drive the contents from the tube. Representative assemblies include rollers positioned on either side of the tube or vice-like jaws designed to progressively squeeze the tube from the end farthest from the tube's opening. In still another design, a key is used in connection with inwardly tapering jaws to wind the end of the tube through the jaws forcing the material out of the wound end.

Up until recently, most collapsible tubes were constructed of metal foil. Thus, a common practice of attempting to evacuate fluid from the lower portion of the tube was to fold or roll the lower end of the tube as fluid was removed from the tube. Since the metal tube would generally hold its shape after being rolled, this proved to be a useful method of preventing the tube's contents from flowing back into the compressed end of the tube. Increasingly, however, these tubes are made from plastic. Due to their elastic nature, plastic collapsible tubes are less likely to remain in a rolled condition and often will unroll quickly after the user has used the tube allowing material to return to the previously evacuated extremity of the tube.

SUMMARY OF THE INVENTION

In light of the foregoing, it is an object of the present invention to provide a retainer used in conjunction with a collapsible tube, the retainer including a body adapted to contact the end of the tube; and at least one tab extending from the body laterally of the tube and adapted to selectively laterally wrap around the tube to hold a portion of the tube in a selected position.

In light of the foregoing object, the present invention generally provides a retainer used in conjunction with an end of a collapsible tube, the retainer including a body adapted to contact the end of the tube, and at least one tab extending from the body laterally of the tube and adapted to selectively laterally wrap around the tube to hold the end in a selected position.

The present invention further provides a retainer including a body having a base portion, an upstanding portion, and a lip portion, extending from the upstanding portion and at last partially over the base portion, wherein the base portion includes a planar surface adapted to contact one surface of the tube, the upstanding portion extends from the base portion and spaces the lip portion from the base portion defining a slot therebetween adapted to receive at least a portion of the end of the tube, and at least one flexible tab extending from the body laterally relative to the tube, wherein the tab is adapted to be selectively folded about the tube to contact a second face of the tube opposite the first face clamping a portion of the tube between the body and the tab.

The present invention further provides a collapsible tube having a first end having an opening through which contents of the tube are released, and a second end opposite the first end including a pair of tabs extending laterally from the second end of the tube, the tabs being adapted to wrap around the tube when the second end is in a folded condition, thereby maintaining the end in the folded condition.

The present invention further provides a retainer used in connection with an end of a collapsible tube, the retainer including a body having generally planar base portion, an upstanding wall extending from one side of the base portion, and a lip from the upstanding portion, wherein said lip extends laterally to substantially the same extent as the base portion, defining a substantially U-shaped cross-section of the body, wherein a clearance is defined between the base portion and the lip portion, the clearance being adapted to receive the end of the collapsible tube, and a pair of tabs extending laterally outward from the body relative to the tube, wherein the tabs are integral with the base portion, the tabs being adapted to selectively wrap around the tube to maintain a selected longitudinal position of the end relative to the tube, whereby the end of the tube is wrapped about the base portion through successive folding of the tube and held in a folded condition by securing the body to the tube with the tabs.

DETAILED DESCRIPTION OF THE INVENTION

Figure 1:
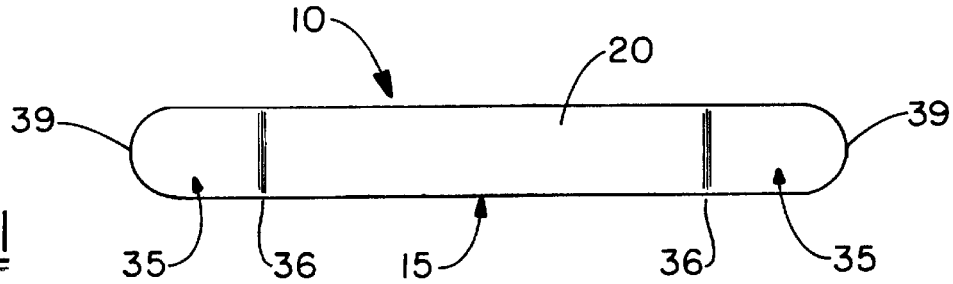
FIG. 1 is a bottom plan view of a retainer according to the present invention.

A retainer according to the concepts of the present invention is depicted in the appended Figs. and generally indicated by the numeral 10. Retainer 10 may be suitably constructed of metals, plastics or combinations thereof. Retainer 10 or a portion thereof may be provided with a coating for safety purposes, to improve grippability, or to prevent corrosion. In general, retainer 10 includes a body, generally indicated by the numeral 15, adapted to be placed in contact with an end 16 of a collapsible tube 17. To that end, body 15 defines an end receiving opening 18 of a size and shape suitable for receiving the end 16 of the collapsible tube 17. In the embodiment depicted in FIG. 5, the end 16 is a rectangular flange formed at the end of the tube 17, and, thus, the end receiving opening 18 is in the form of a slot. It is appreciated that the end 16 of the collapsible tube 17 may have different configurations requiring adaptation of the opening 18 to receive the end 16. Such adaptation is considered within the scope of the present invention.

Figure 2:
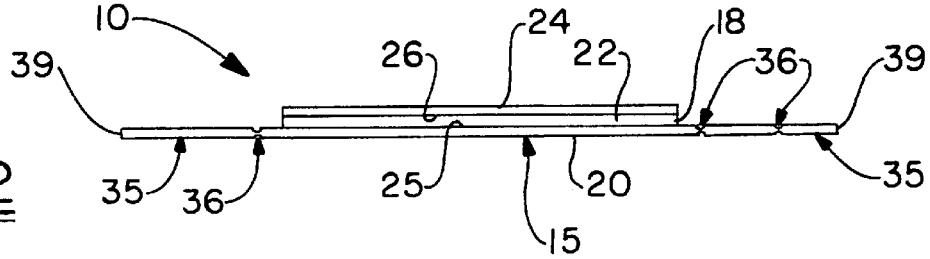
FIG. 2 is a front elevational view of a retainer according to the present invention.
Figure 3:
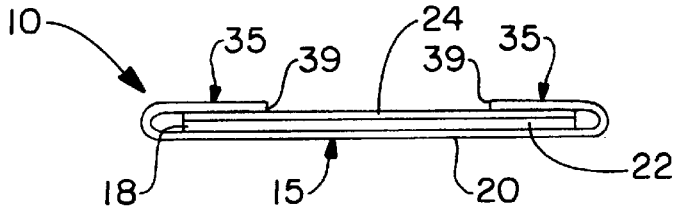
FIG. 3 is a front elevation view similar to FIG. 2 shown with the tabs in a secured position.
Figure 5:
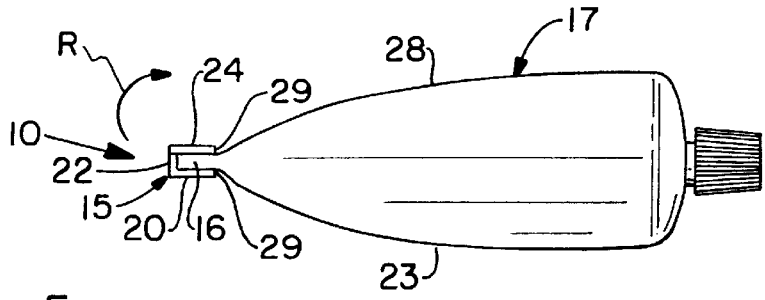
FIG. 5 is a side elevational view of a retainer and collapsible tube, depicting a retainer slid unto the end of the collapsible tube.

In the example shown, in FIGS. 1–3, body 15 includes a base portion 20, an upstanding member 22 and a lip portion 24. As shown in FIG. 5, base portion 20 may be a generally planar thin walled member having an interior surface 25 adapted to fit closely against a surface 23 of the collapsible tube 17. Lip 24 may be similarly formed such that lip 24 has an interior surface 26 that closely conforms to the surface 28 of tube 17 opposite base portion 20. The height of upstanding portion 22 may be made such that the clearance 18 defined between the base and lip portions 20,24 closely conform to the thickness of the end 16. Further, the clearance 18 may be such that an interference fit is formed between the body 15 and the end 16, as by frictional contact between the end 16 and the base and lip portions 20, 24.

It will be appreciated that attachment of the body 15 to the end 16 of the tube 17 is not necessary and body 15 may include only a single member placed against the end 16 of the tube. Moreover, as described in more detail below, the body 15 may be omitted altogether.

While the body 15 is shown as a generally planar member having flat surfaces 25, 26 that bear upon the end of the tube 17, it will be appreciated that the body 15 may be formed with virtually any shape and cross-section. The planar cross-section shown, incorporating thin walled structures, such as, base portion 20 and lip portion 24, tend to reduce the bulk of the retainer 10. As a consequence, when rolling or folding the tube around the thin walled body 15, the resulting folded structure, generally indicated by the numeral 30, also has less bulk. This facilitates retention of the folded position, as will be apparent from the description below. The planar body 15 may facilitate folding of the tube 17, by providing a flat surface 25 or 26 that may be used to compress the end of the tube against a supporting surface, such as a table, aiding in expelling fluid from the lower portion of the tube 17 and providing an axis, which in this example is defined by the front edge 29 of the body 15, about which the tube 17 may be bent or folded.

It will be appreciated that polygonal structures may provide a similar axis and would perform suitably to expel and fold the end of the tube about their sides, or bodies having a non-planar outer surface would be suitable for folding and in some cases facilitate rolling of the end 16 of the tube 17, which is a suitable alternative method of expelling fluid from the lower portions of the tube 17, as is well known in the art. For example, a cylindrical body 15 would be useful in rolling the end 16 of the tube 17. Thus, as mentioned above, virtually any cross-section may be used in accordance with the concepts of the present invention. For simplicity, however, the description will proceed with reference to the planar cross-section body 15 shown in the FIGS. 1–7.

Figure 6:
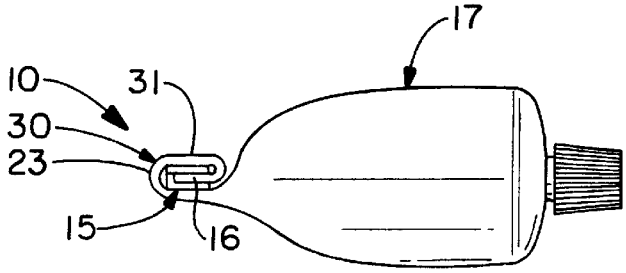
FIG. 6 is a side elevational view similar to the FIG. 5, depicting the tube with a quantity of material removed and the end of the tube in a folded condition with the retainer tabs in a secured position.

As best shown in FIG. 6, as the contents of the tube 17 are expelled, the effective volume of the tube 17 may be reduced by gathering the end 16 of the tube 17, as indicated at 30. Retainer 10 may be used to compress the tube 17 to assist in driving the tube's contents from the lower portion of the tube 17. To cause the body 15 of the retainer 10 to bear upon the fluid filled tube 17, when the retainer is initially placed in contact with the end 16, body 15 may be oversized relative to the end flange 16. The body 15 may extend longitudinally to a greater extent than end flange 16, such that, either or both of the base and lip portions 20,24 contact a fluid filled region of the tube 17 allowing the user to apply pressure to these portions to drive fluid from the tube 17. In the example shown, the end 16 of the tube 17 has been folded about the body 15 of the retainer 10 by rotating the retainer 10 in a clockwise direction, indicated by the arrow R, in FIG. 5, it being appreciated that any direction is suitable depending on the user's preference, wrapping the tube 17 in consecutive folds about the body 15 of retainer 10 to achieve the folded condition 30, shown. In this way, the end 16 of the tube 17 is advanced in the longitudinal direction with the contents substantially expelled from the folds 31 formed about the retainer 10 to effectively shorten the length of the tube 17 and reduce its volume. In addition to expelling the contents from the end 16, the folds 31 are intended to prevent the material from reentering the end 16 as the user further compresses the tube 17 to release additional contents.

Figure 7:
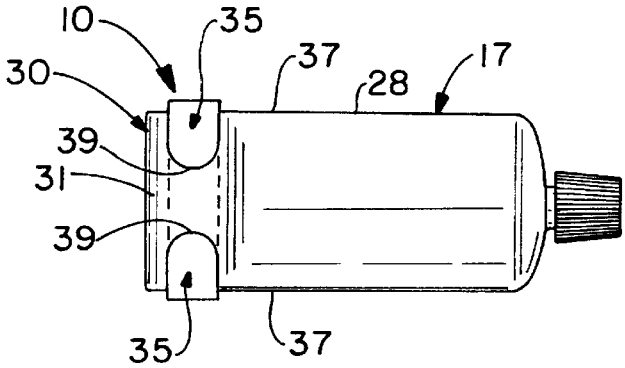
FIG. 7 is a bottom plan view of the collapsible tube depicted in FIG. 6 showing the tabs wrapped around the lateral edges of the tube to hold the end of the tube in the folded condition.

To maintain the retainer 10 and end 16 in the selected longitudinal position relative to the tube 17, one or more tabs, generally indicated by the numeral 35, extend laterally from the body 15. A pair of tabs 35, 35 are depicted in FIG. 2, extending an equal length from the body 15 such that the opposed tabs 35, 35 tend to balance any torsional forces that would be created by the tendency of the tube 17 to unroll or unfold (FIG. 7). In the example shown, tabs 35 may extend from the base portion 20 (FIG. 2) or lip portion 24 (FIGS. 5 and 7). Tabs 35 are constructed of a flexible material such that they may be wrapped around the lateral edges 37 of the tube 17 to clamp the folds 31 between the tab 35 and the base member 20. To maintain the folded condition 30, tabs 35 are designed to hold their shape after being wrapped around the tube 17. To facilitate folding of the tabs 35 around the lateral edges 37 of tube 17 the tabs 35 may be provided with localized weak zones, generally indicated by the numeral 36, which may be created in any known manner including locally removing material from the retainer 10, pre-stressing areas, or various heat or surface treatments. For example, a score line 36, may be formed in the tabs 35 near the body 15 or at various increments on the tab 35. Score line 36 may extend in any fashion to locally weaken the tab 35 and is shown extending parallel to the longitudinal axis of the tube 17, for purposes of example.

Multiple weakened zones 36 may be created to account for the changes in the folding position that will occur as the tab 35 has to encompass additional folds 31 or to accommodate tubes 17 having different widths. Since the tabs 35 may be turned up or down, the zones 36 may be formed on one or both sides of the retainer 10. For example, a pair of zones 36 may be formed on either side of a tab 35 and lie in the same plane. As showing in the example of score lines 36, opposed wakened zones may extend along a common line within the same plane. Zones 36 may be located at any position on or adjacent tabs 36, and the position of the weakened zones 36, shown, are provided only as an example.

To release the folds 31, as when further folding is necessary, the tabs 35 may be unfolded by the user. To prevent the forming of sharp edges, the exposed ends 39 of the tabs 35 may be rounded. It will be appreciated that the tabs 35 may be wrapped upward or downward depending upon the extent that the body 15 has been rotated, for example, a half turn, 180° rotation would require the tabs 35 to be folded in one direction, for example downward and a full turn, 360° rotation, would require tabs 35 be folded in another direction, for example up. To help visualize this concept, the tube 17 shown in FIG. 6 has a retainer 10 that has been rotated a full turn, such that, the base portion 20 is on the bottom of the body 15, shown in that Fig. and the opening 18 is facing forward. If the body 15 had been rotated only a half turn, the base portion 20 would be on top and the opening 18 would face rearwardly of the tube 17. The degree of turn discussed is provided, for example, only to help the reader visualize the use of the tabs 35 and is not intended to limit the use of the present invention to a particular mode.

Figure 8:
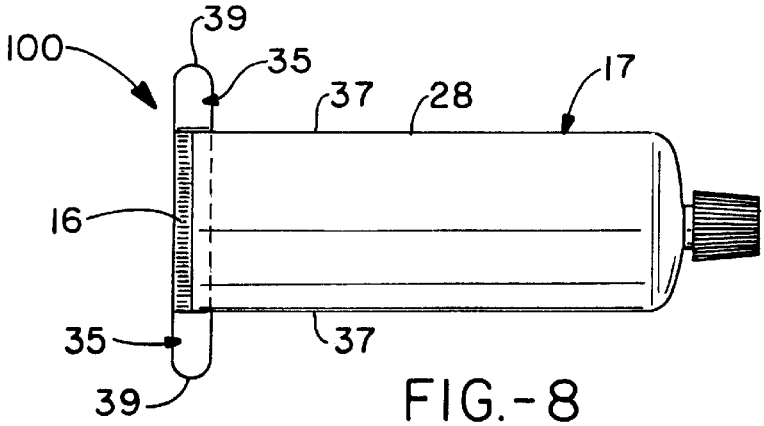
FIG. 8 depicts an alternative embodiment of the present invention showing integrally formed tabs formed on the end of a collapsible tube.

An alternative embodiment of the present invention is depicted in FIG. 8 and generally indicated by the numeral 100. In this embodiment, the body 15 has been omitted and the tabs 35, 35 have been integrally formed on the tube 17. There, tabs 35, 35 extend laterally of edges 37, 37 and may operate in the fashion previously described to hold the end 16 of the tube 17 once it has been rolled or folded. It will be appreciated that the body 15 might also be formed integrally with the tube 17 to provide a surface that bears against the tube to drive the contents from the lower portion of the tube 17, as described in the previous embodiment.

Figure 4:
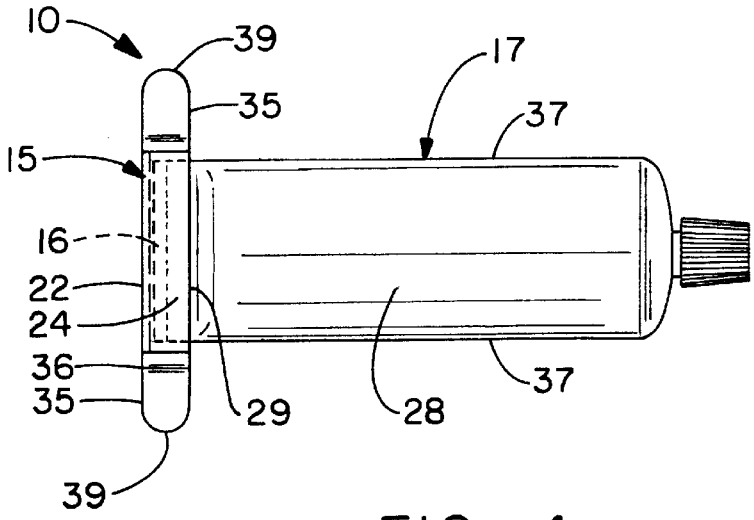
FIG. 4 is a top plan view of a retainer according to the present invention shown attached to an unrolled end of a collapsible tube with the tabs in an unsecured position.

With reference to FIGS. 5–7, operation of retainer 10 will be described with reference to the example shown therein. This discussion is for exemplary purposes and is not intended to limit use of the retainer 10 to a particular mode of operation. With that said, body 15 of retainer 10 is initially placed against the end 16 of the tube 17, as best shown in FIG. 4. As discussed previously, the body 15 may include a single member having tabs 35, 35 extending therefrom. In this instance, the body 15 might be placed above or below the end 16 of tube 17, and, then, the end 16 of the tube would be rolled or folded about the body 15 to drive contents from the tube 17. Once the tube 17 was sufficiently compressed i.e., sufficient contents were expelled from the tube 17, the tabs 35 would be laterally wrapped around the edges 37 of tube 17 extending inwardly over a portion of the tube 17 and pinched to compress the tube 17 between the body 15 and the tabs 35. For example, as shown in FIG. 6, the tube 17 may be rolled or folded about the body 15 to obtain a folded condition 30 and then held in that condition 30 by clamping of the folds 31 between the body 15 and the tabs 35. As mentioned above, folding, rolling or other methods of effectively reducing the volume of the tube 17 may be used and the gathered portion 30 of the tube 17 secured by the retainer 10.

Considering the embodiment shown, in more particularity, body 15 may include an end receiving opening or clearance 18 defined between a base portion 20 and a lip portion 24, which are spaced from each other by an upstanding portion 22, which may simply be a bend between the base and lip portions 20,24. The upstanding portion 22 may extend the entire length of the body and lip portions 20, 24 such that a generally U-shaped slot 18 is formed to receive the end 16 of tube 17. As best shown in FIGS. 4 and 5, the body 15 may be slid onto the end 16 of the tube 17 with the end 16 residing within slot 18 between the base portion 20 and lip portion 24. If necessary, end 16 may abut the upstanding portion 22, as shown in FIG. 5. At this point to expel contents from the tube 17 or simply fold the tube 17 after contents have been expelled from it, the body 15 may be rotated, as indicated by the arrow R, to fold the tube 17 about the body 15. As best shown in FIG. 6, rotation of the body 15 through 360° results in a fold 31 of tube 17 that wraps around the base portion 20 adjacent upstanding portion 22 and over lip portion 24 with the end 16 extending into the slot 18 defining a generally lower case e-shaped section. The user may apply pressure to the body 15, as the folding process continues, to flatten the tube 17 beneath body 15 driving the contents from the lower portions of the tube 17. To secure the folded end 30 of tube 17, the tabs 35 are wrapped around the lateral edges 37 of tube 17 and pinched against the folded section 30 of tube 17 clamping it against the body 15, as shown in FIGS. 6 and 7. In this way, the clamping of the rolled or folded end 30 between tabs 35 and body 15 prevents the folded end 30 from unrolling and allowing the contents to flow back into the previously flattened and folded end 30.

In light of the foregoing, it should thus be evident that the retainer of the present invention is a new and useful improvement upon the art. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. A retainer used in conjunction with a collapsible tube, the retainer comprising:

a body adapted to contact the end of the tube; and at least one tab extending from said body laterally of the tube and adapted to selectively laterally wrap around a portion of the tube to hold the tube in a selected position, said tab including a weakened zone formed on said tab, whereby said weakened zone facilitates folding of said tab.

2. The retainer of claim 1, wherein said tab has a plurality of weakened zones formed at laterally spaced intervals, whereby said plurality of weakened zones facilitate folding of said tab at plural positions.

3. The retainer of claim 1, wherein said weakened zone includes a pair of score lines formed on opposite sides of said tab, said score lines being collinear and coplanar with respect to each other.

4. The retainer of claim 1 further comprising a score line formed in said body adjacent said tab.

5. The retainer of claim 1, wherein said body and tab are formed in a punch process.

6. The retainer of claim 1, wherein said weakened zone includes a score line formed in said tab.

7. The retainer of claim 6, wherein said score line extends longitudinally relative to the tube.

8. A collapsible tube having a first end having an opening through which contents of the tube are released, and a second end opposite the first end comprising a pair of tabs extending laterally from the second end of the tube, said tabs being adapted to wrap around a portion of the tube when the second end is in a folded condition, thereby maintaining said end in said folded condition.

* * * * *